US008464565B2

(12) United States Patent
Hiraishi

(10) Patent No.: US 8,464,565 B2
(45) Date of Patent: Jun. 18, 2013

(54) SYSTEM FOR SUPPLYING LUBRICANT, APPARATUS FOR MANUFACTURING SEAMLESS PIPES OR TUBES, AND METHOD OF MANUFACTURING SEAMLESS PIPES OR TUBES

(75) Inventor: Yusuke Hiraishi, Osaka (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 1433 days.

(21) Appl. No.: 10/584,271

(22) PCT Filed: Dec. 24, 2004

(86) PCT No.: PCT/JP2004/019391

§ 371 (c)(1),
(2), (4) Date: May 22, 2007

(87) PCT Pub. No.: WO2005/061137

PCT Pub. Date: Jul. 7, 2005

(65) Prior Publication Data

US 2007/0214855 A1 Sep. 20, 2007

(30) Foreign Application Priority Data

Dec. 24, 2003 (JP) ..... 2003-427581

(51) Int. Cl.
*B21B 45/02* (2006.01)

(52) U.S. Cl.
USPC ..... 72/45; 72/43

(58) Field of Classification Search
USPC ..... 72/41–45, 236
See application file for complete search history.

(56) References Cited

U.S. PATENT DOCUMENTS

| | | | | | |
|---|---|---|---|---|---|
| 1,659,591 | A * | 2/1928 | Busey | ..... | 72/45 |
| 3,823,599 | A * | 7/1974 | Litz et al. | ..... | 73/10 |
| 4,315,421 | A * | 2/1982 | Wilson | ..... | 72/42 |
| 5,282,376 | A * | 2/1994 | Steele et al. | ..... | 72/43 |
| 5,460,023 | A * | 10/1995 | Ginzburg | ..... | 72/43 |
| 5,983,689 | A * | 11/1999 | Yorifuji et al. | ..... | 72/42 |
| 6,330,818 | B1 * | 12/2001 | Jain | ..... | 72/42 |

FOREIGN PATENT DOCUMENTS

| | | |
|---|---|---|
| AR | 197861 | 5/1974 |
| CN | 1086159 | 5/1994 |
| CN | 2574794 | 9/2003 |
| JP | 62-173013 | 7/1987 |
| JP | 2-224808 | 9/1990 |
| JP | 03-169411 | 7/1991 |
| JP | 4-105705 | 4/1992 |
| JP | 04-288916 | 10/1992 |
| JP | 05214358 A * | 8/1993 |
| JP | 06-015311 | 1/1994 |

(Continued)

*Primary Examiner* — Dana Ross
*Assistant Examiner* — Lawrence J Averick
(74) *Attorney, Agent, or Firm* — Clark & Brody

(57) ABSTRACT

The present invention provides a system for supplying a lubricant necessary for efficiently manufacturing high-quality seamless pipes or tubes in a piercing mill, an apparatus for manufacturing seamless pipes or tubes having the supply system, and seamless pipes or tubes manufacturing method. The system for supplying a lubricant has a storage tank of the lubricant, a plumbing extending from the storage tank to a position near disk rolls, a nozzle provided at the tip of the plumbing, a device for switching flow direction provided in some midpoint of the plumbing, a plumbing extending from the device for switching flow direction to the storage tank, and a device for releasing pressure in a plumbing, provided between the switching device and the nozzle.

14 Claims, 11 Drawing Sheets

FOREIGN PATENT DOCUMENTS

| | | | | |
|---|---|---|---|---|
| JP | 06-099206 | | | 4/1994 |
| JP | 6-292910 | | | 10/1994 |
| JP | 08-215717 | | | 8/1996 |
| JP | 2641834 | | | 5/1997 |
| JP | 09292094 | A | * | 11/1997 |
| JP | 10-028902 | | | 2/1998 |
| JP | 11035967 | A | * | 2/1999 |

* cited by examiner

SYSTEM FOR SUPPLYING LUBRICANT, APPARATUS FOR MANUFACTURING SEAMLESS PIPES OR TUBES, AND METHOD OF MANUFACTURING SEAMLESS PIPES OR TUBES

TECHNICAL FIELD

The present invention relates to a method and apparatus for manufacturing seamless pipes or tubes and, more particularly, to a system for supplying a lubricant to a piercing mill.

BACKGROUND ART

Seamless pipes or tubes are used in many industrial fields such as energy, automobile, chemical, industrial equipment, construction, and the like. Particularly, they are used as an oil well and for transport of crude oil or gas. They play important roles in the fields related to energy resource development in the world.

FIG. 10 schematically shows an example of a representative process of manufacturing seamless pipes or tubes. In FIG. 10, a billet 100 as the material of seamless pipes or tubes is loaded in a rotary hearth type heating furnace 2 and heated. The heated billet 100 is taken out from the furnace 2 and is subjected to piercing in a piercer (hereinbelow, called "piercing mill") 300, thereby becoming a hollow shell 4. Subsequently, a mandrel bar 5*a* is inserted into the hollow shell 4 from the rear end, and the hollow shell 4 is elongated by mandrel mill 5 configured by roll stands of five to nine stages to a predetermined dimension.

After that, the mandrel bar in the hollow shell 4 is pulled out, and the hollow shell 4 is hot rolled by a sizing mill 6. The hot rolled pipes or tubes are cooled on a cooling bed 7, cut to the given length, and straightened.

FIG. 11 shows the piercing mill 300 which has a pair of main rolls 111 facing each other in the vertical direction and a pair of disc rolls 112. Both of the rotary axes of the disc rolls 112 are perpendicular to a piercing axis X of the main rolls 111. Both of the main rolls 111 rotate in the same direction. Each of the rotary axes of the main rolls 111 crosses in plan view.

Each guide face 112*a* of the disc rolls 112 is a curved shape to stably hold a hollow shell. The disc rolls 112 which are disposed near the main rolls 111 guide the billet 100 and hold a hollow shell by the guide faces 112*a* to keep the shape of a hollow shell.

A cannon 113 which guides the billet 100 at the inlet side of a piercing mill is disposed on the upstream side of the main rolls 111 and a plug bar 114 having an axis same as the piercing axis X1 and supporting a plug at its tip is disposed on the downstream side of those.

As the main rolls 111 rotate in same direction, the billet 100 is fed to the downstream and pierced by the plug bar 114.

As described above, during piercing, the billet 100 or the hollow shell 4 (hereinafter, the billet 100 and the hollow shell 4 are also called as "material") rotates on the piercing axis X1. On the other hand, the disc rolls 112 rotate on the axis which crosses the piercing axis X1. Consequently, relative slip occurs between disc rolls and material.

In the case of carbon steel, oxide film forms thickly on the material surface by heating in preparation. The oxide film is interposed between the material and the disc rolls 112 during piercing. Consequently, seizure does not occur so much between disc rolls and material.

On the other hand, in the case of high alloy steel such as 13Cr or stainless steel, the oxide film does not form thickly on the material surface, even at high temperature. Therefore, piercing often results in seizure of the billet 100 being pierced and the disc rolls 112. The seizure causes damage on the surface of the hollow shell 4. Additional process such as material grinding of surface, re-polishing of guide face, or attachment/detaching of disc rolls to/from apparatus is required to remove damage caused by seizure. It results in interruption of operation and is consequently disadvantageous from the viewpoint of time and cost.

As a countermeasure against seizure between the material and the disc rolls, a method of spraying lubricant onto the surface of the disc roll guide faces 112*a* is considered. The "lubricant" herein is different from a normal "lubricant" such as rolling oil, working fluid, or coolant used for reducing friction coefficient. Its principal objective is to prevent seizure. Therefore, in some cases, the friction coefficient between disc roll and material increases.

For example, Patent official gazette 1 discloses a piercing mill 300 in FIG. 11, which has the nozzle 115 for spraying lubricant to main rolls 111 during piecing to prevent slip between the billet 100 and the surface of the main rolls 111. The nozzle is fixed to the end of the cannon 113 at piercing mill side.

Non-patent document 1 discloses lubricant for spraying onto the surface of main rolls, which is made of mostly mixed aqueous solution of boric acid and film forming agent.

Patent official gazette 1: Japanese Patent No. 2,641,834 (p 2, FIGS. 1 and 2)

Non-patent document 1: "Material and process", The Iron and Steel Institute of Japan, Vol. 8 (1995), p 1218

DISCLOSURE OF THE INVENTION

Problems to be Solved by the Invention

Lubricants in the present invention have higher viscosity than ordinal lubricants and itself is apt to be blocked up in the plumbing. And requirement for spraying lubricant to disc rolls is different from that for using lubricant in other ways such as spraying main rolls. For the disc rolls, it needs to spray necessary volume of lubricant to accurate portion, at right timing during piercing.

However, the apparatus and the method for supplying a lubricant which meet the requirement has not been disclosed yet.

The method showing at patent official gazette 1 has the following problems;

1) Since the cannon has to be prepared to fit for the dimension of each of the billets, a number of nozzles which fit cannon 113 are necessary.

2) At the time of replacing the cannons, the plumbing which connects nozzles has to be put out. It may be troublesome.

3) The lubricant is sprayed on the surface of the main rolls, so that the lubricant hardly adhere onto the guide face 112*a*. It often results in seizure or wear on the guide face 112*a*.

An object of the present invention is to provide a system for supplying a lubricant necessary for efficiently manufacturing high-quality seamless pipes or tubes in a piercing mill, an apparatus for manufacturing seamless pipes or tubes having the supply system for lubricant, and manufacturing method of seamless pipes or tubes.

Means for Solving the Problems

A first aspect of the present invention is a system for supplying a lubricant to a pair of disc rolls of a piercing mill, comprising: a storage tank of the lubricant; a plumbing extended from the storage tank to a position near the disk rolls; an nozzle placed at the tip of the plumbing; a device for switching flow direction placed in some midpoint of the plumbing; a plumbing extending from the device for switching flow direction to the storage tank; and a device for releasing pressure in the plumbing, placed between the switching device and the nozzle.

In the first aspect of the present invention, the system may have a flow controller for controlling flow rate of the lubricant in each plumbing directly connected to the nozzle.

In the first aspect (including modifications), the nozzle may be configured so as to be flexibly directed toward the guide face of the disc rolls in accordance with change in a size or a position of the disc rolls.

Further, in the first aspect (including modifications) of the present invention, the system may have a cleaning device for the plumbing.

In the first aspect (including modifications) of the present invention, the system may further include a device for supplying a solidifier for solidifying the lubricant.

A second aspect of the present invention is an apparatus for manufacturing seamless pipes or tubes, comprising: a rolling mill including a plug oriented in a piercing direction, a pair of disc rolls disposed on both sides of an axis of the plug in the first plane including the axis, and a pair of main rolls disposed on both sides of the axis with a predetermined inclination to the second plane including the axis and orthogonal to the first plane; and a system for supplying a lubricant including a storage tank of the lubricant to be sprayed to the disc rolls, a plumbing extending from the storage tank to a position near the disk rolls, an nozzle placed at the tip of the plumbing, a device for switching flow direction placed in some midpoint of the plumbing, a plumbing extending from the device for switching flow direction to the storage tank, and a device for releasing pressure in the plumbing, placed between the device for switching flow direction and the nozzle.

In the second aspect of the present invention, the apparatus may further include: a multiaxial arm which holds the nozzle and change spraying direction of the nozzle; and a unit for moving the multiaxial arm forward/backward to/from the rolling mill.

A third aspect of the present invention is a method of manufacturing seamless pipes or tubes by using a piercing mill having a pair of disc rolls while spraying a lubricant to the disc rolls, comprising: spraying the lubricant to the disc rolls during piercing; circulating the lubricant through a plumbing when the piercing mill is not at; and releasing pressure in the plumbing which connects the nozzle.

In the third aspect of the present invention, the lubricant may be sprayed toward a guide face at an angle within five degrees to a center plane which is parallel to the side of the disc rolls and passes the center in the width direction of the guide face.

In the third aspect of the present invention, the lubricant may be sprayed to the disc rolls at the inlet side of a piercing mill.

A fourth aspect of the present invention is seamless pipes or tubes manufactured by a manufacturing method according to the third aspect (including modifications) of the invention.

Effects of the Invention

According to the present invention, the proper volume of the lubricant is provided to the position between the disc rolls and the material, so that high-quality seamless pipes or tubes can be efficiently manufactured. The lubricant having the nature that it is relatively easily solidified in the plumbing can be smoothly supplied from a storage tank to a nozzle or can be circulated in the plumbing.

According to the present invention, the same nozzle can be used irrespective of a change in the size or position of the disc rolls or equipment conditions such as the position setting, or the like. Moreover, the lubricant can be evenly sprayed to the guide face without causing a portion which is interrupted of the lubricant spray by the circular shape of the guide face. Since the lubricant can be evenly sprayed to the guide face of the disc rolls, the frequency of the seizure on the guide face and troubles at piercing caused by the seizure are reduced. Further, the same nozzle can be used, it becomes unnecessary to the replace of nozzles frequency.

DESCRIPTION OF REFERENCE NUMERALS

Figure 1:
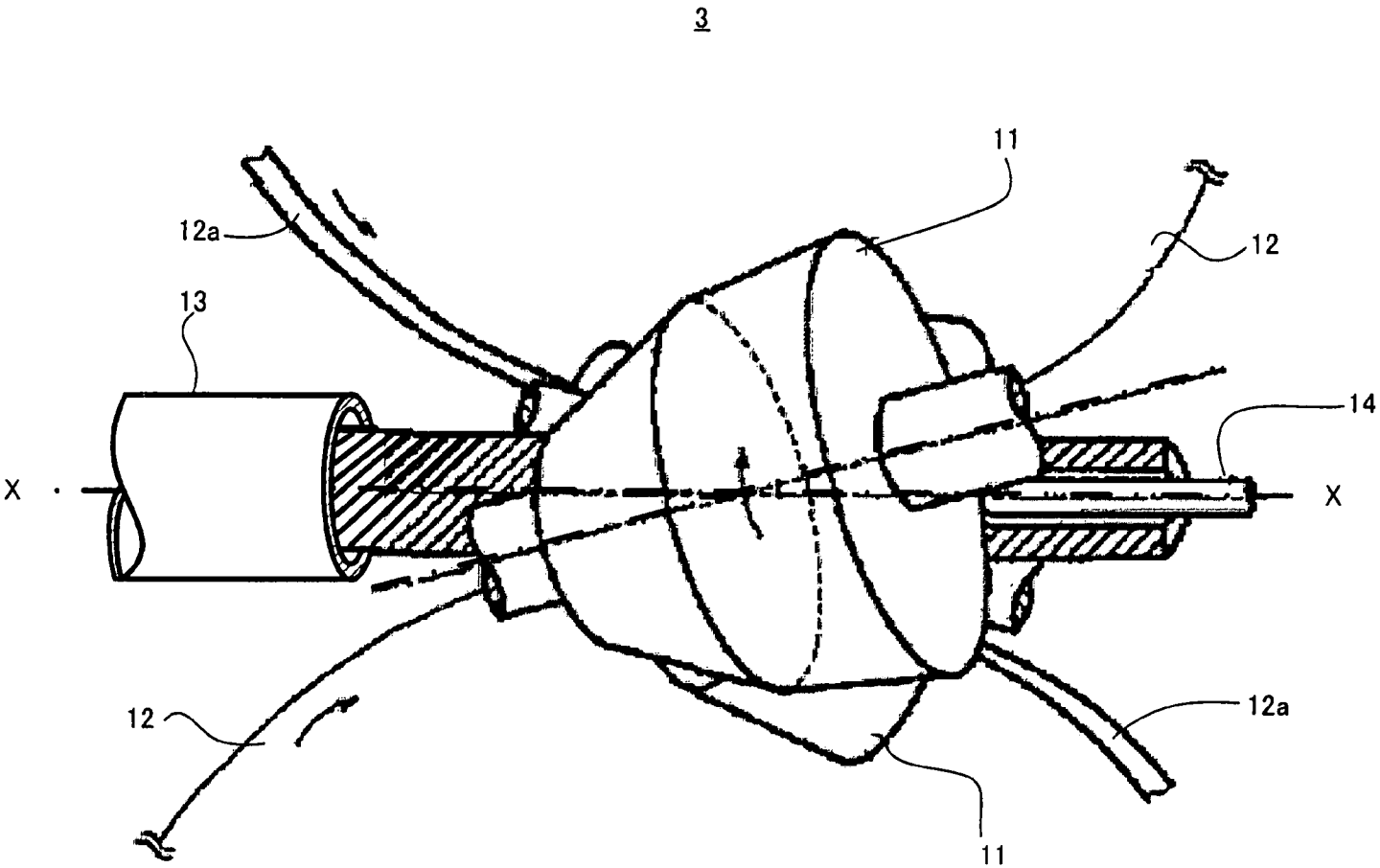
FIG. 1 is a perspective view showing a piercing mill.

| | |
|---|---|
| 1 | billet |
| 2 | rotary hearth type heating furnace |
| 3 | piercing mill |
| 4 | hollow shell |
| 5 | mandrel mill |
| 6 | sizing mill |
| 7 | cooling bed |
| 11 | main rolls |
| 12 | disc rolls |
| 12a | guide face |
| 12b | plane |
| 13 | cannon |
| 14 | plug bar |
| 15 | nozzle |
| 16 | support |
| 17 | housing |
| 20 | spraying device |
| 21, 24, 25, 26 | nozzles |
| 21a | joint |
| 21b | nozzle tip |
| 21c | intermediate member |
| 22 | multiaxial arm |
| 22a | first arm |
| 22b | second arm |
| 22c | third arm |
| 22d | fourth arm |
| 22e | fifth arm |
| 22f | sixth arm |

-continued

| | |
|---|---|
| 23 | unit for moving the multiaxial arm |
| 23a | guide board |
| 23b | rail |
| 23c | ball screw |
| 23d | motor |
| 23e | sensor |
| 23f | coupling |
| 23g | seating |
| 50 | controller |
| X | piercing axis |
| Y | center plane |

BEST MODE FOR CARRYING OUT THE INVENTION

A system for supplying a lubricant according to the present invention includes: a storage tank of the lubricant; a plumbing extended from the storage tank to a position near disk rolls; nozzles placed at the tip of the plumbing; a device for switching flow direction placed in some midpoint of the plumbing; a plumbing extending from the device for switching flow direction to the storage tank; and a device for releasing pressure in a plumbing, placed between the switching device and the nozzles.

The reason why the system for supplying the lubricant according to the present invention has the device for switching flow direction and the plumbing extending from the device to the storage tank is the following. Since the lubricant according to the present invention has high viscosity and tends to clog the plumbing, even if the piercing mill is not at work and the lubricant does not have to be sprayed, the lubricant is circulated to prevent the solidification in the plumbing. The device for releasing pressure in the plumbing is placed between the switching device and the nozzles in order to prevent the slip which occurs between the main rolls and the material due to a drop of the lubricant from the nozzles on to the main rolls by residual pressure, while the piercing mill is not at work. And it prevents the contamination of the factory environment due to adhesion of the lubricant to the surrounding equipment.

The system for supplying the lubricant according to the present invention further includes a flow controller for controlling flow rate of the lubricant in each plumbing directly connected to the nozzles in order to spray the optimum volume of the lubricant. The optimum volume varies with the portion of the disc rolls or the timing of the spraying.

In the system for supplying the lubricant according to the present invention, the nozzles are able to be flexibly directed toward the guide face of the disc rolls in accordance with change in a size or a position of the disc rolls, because of the following reason. The piercing mill has to pierce a hole in the hollow shells made of various kinds of material or size. Therefore, the condition of the piercing mill such as the feed angle and the cone angle has to be changed as to materials. And the condition of the disc rolls has to be changed. The condition of the disc rolls denotes diameter, width, the angle of the rotary axis with the vertical line, the position in the vertical direction, or the distance between the rotary axis of the disc rolls. The position and the direction of the guide face also vary. Therefore, the nozzle has to be directed toward the desirable portion for spraying in accordance with the disc rolls.

The system for supplying the lubricant according to the present invention further includes a device for cleaning the inside of the plumbing for the following reason. If the lubricant is left in the plumbing in a non-fluid state while the piercing mill is not at work for a long time, the lubricant may solidify and clog the plumbing. Therefore, the device for cleaning the inside of the plumbing is provided. While the piercing mill is not at work, the lubricant is removed from the inside of the plumbing. It prevents the above-described plumbing trouble.

The system for supplying the lubricant according to the present invention further includes a device for supplying a solidifier for solidifying the lubricant that is two-solution mixture type. This type lubricant reliably adheres to the guide faces of the disc rolls and prevents seizure. This type lubricant is mixed a second solution with a main solution. The second solution solidifies the main solution and is separately sprayed to the disc rolls. On the guide face, both of the solutions are mixed, the main solution solidifies, and a solid lubrication film is formed. Consequently, it is necessary to supply the second solution to the guide face separately from the main solution, so that the device for supplying the solidifier as the second solution is separately provided.

An apparatus for manufacturing seamless pipes or tubes according to the present invention includes: a piercing mill including a plug oriented in a piercing direction, a pair of disc rolls disposed on both sides of an axis of the plug in the first plane including the axis, and a pair of main rolls disposed on both sides of the axis with a predetermined inclination to the second plane including the axis and orthogonal to the first plane; and a system for supplying a lubricant including a storage tank of the lubricant to spray to the disc rolls, a plumbing extending from the storage tank, a nozzles placed at the tip of the plumbing, a device for switching flow direction placed in some midpoint of the plumbing, a plumbing extending from the device for switching flow direction to the storage tank, and a device for releasing pressure in the plumbing, placed between the device for switching flow direction and a nozzle.

The reason why the apparatus for manufacturing seamless pipes or tubes according to the invention has the device for switching flow direction and the plumbing extending from the device to the storage tank is the following. Specifically, since the lubricant according to the present invention has high viscosity and tends to clog the plumbing, even if the piercing mill is not at work and the lubricant does not have to be sprayed, the lubricant is circulated in the plumbing to prevent the plumbing from the clogging.

The device for releasing pressure in a plumbing is placed between the switching device and the nozzle in order to the slip which occurs between the main rolls and the material due to a drop of the lubricant from the nozzle onto the main rolls by residual pressure, while the piercing mill is not at work. And it prevents the contamination of the factory environment due to adhesion of the lubricant to the surrounding equipment.

The apparatus for manufacturing seamless pipes or tubes according to the present invention further includes: a multiaxial arm to which the nozzles are attached and which can change the direction of the nozzles; and a unit for moving the multiaxial arm forward/backward to/from the piercing mill. The multiaxial arm and the unit are able to move the nozzles three-dimensionally. In addition, they can move the nozzle without touching other members in the limited space and the nozzles can spray the lubricant toward the guide face in accordance with the position or the direction of the guide face.

According to the present invention, a method of manufacturing seamless pipes or tubes by using a piercing mill having a pair of disc rolls while spraying a lubricant to the disc rolls, includes: spraying the lubricant to the disc rolls during piercing; circulating the lubricant in a plumbing while the piercing mill is not at work; and releasing pressure in the plumbing near the nozzle.

In the method of manufacturing seamless pipes or tubes according to the present invention, the reason why the lubricant is sprayed to the disc rolls during piercing and is circulated in the plumbing while the piercing mill is not at work is the following.

Since the lubricant according to the present invention has high viscosity and tends to clog the plumbing, even if the piercing mill is not at work and the lubricant does not have to be sprayed, the lubricant is circulated in the plumbing to prevent from clogging.

In the method of manufacturing seamless pipes or tubes according to the present invention, the reason why the pressure in a plumbing placed between the switching device and the nozzles is released is to prevent the slip which occurs between the main rolls and the material due to a drop of the lubricant from the nozzles onto the main rolls by residual pressure, while the piercing mill is not at work. And it is to prevents the contamination of the factory environment due to adhesion of the lubricant to the surrounding equipment.

In the method of manufacturing seamless pipes or tubes according to the present invention, the reason why the lubricant is sprayed toward a guide face at angles within five degrees from a center plane, which is parallel to the side of the disc rolls and passes the center in the width of the guide face is the following. In the case of spraying the lubricant toward the guide faces of the disc rolls, it is for seamless pipes or tubes having a small or intermediate diameter, at the angle larger than five degrees with the center plane, each end of the guide face obstructs the sprayed lubricant and the lubricant cannot be sufficiently and uniformly adhered to the guide face. The reason why the lubricant is sprayed toward the guide face is the following. Since the shell is hold by the guide face, strained, and traveled spirally, the guide face contacts the shell intricately during piercing and the seizure tends to occur at the guide face more than any other portions. Consequently, the prevention of the seizure is required strongly.

In the method of manufacturing seamless pipes or tubes according to the present invention, the lubricant is sprayed at the inlet side of a piercing mill. Since the spraying direction of the lubricant is the same as the travel direction of the material, even if the lubricant is splashed or adhered to the main rolls or the material, the lubricant is immediately leaded to the portion where the guide face and the material contact. It is not necessary to removed the lubricant from the main rolls.

In the present invention, since the apparatus, which includes a multiaxial arm that holds the nozzle and change spraying direction of the nozzle and a unit that moves the multiaxial arm forward/backward to/from the rolling mill, is adopted, it becomes unnecessary to replace the nozzle. Moreover, it become facilitated to adjust the nozzle finely, for example use/unuse of the nozzle, backing from the spraying position, forward/backward travel.

The present invention can be applied to the case where the disc roll diameter is 1500 to 4000 mm, the disc roll width is 160 to 360 mm, and the radius of the guide face curve is 160 to 360 mm. The lubricant made of a boric material, a lubricant made of a mica material, or the like can be also used.

The present invention will be described below with reference to the drawings.

FIG. 1 is a schematic perspective view showing a piercing mill according to an embodiment of the present invention. A piercing mill 3 shown in the diagram has a pair of main rolls 11 facing each other in the vertical direction. Both of the rotary axes of disc rolls 12 are perpendicular to the piercing axis X of the main rolls 11. Both of the main rolls 11 rotate in the same direction. Each of the rotary axes of the main rolls 11 crosses in plan view.

Each guide face 12*a* of the disc rolls 12 is a curved shape to stably hold a hollow shell. The disc rolls 12 which are disposed near the main rolls 11 guide a billet and hold a hollow shell by guide faces 12*a* to keep the shape of a hollow shell.

A cannon 13 is disposed on the upstream side of the main rolls 11. A plug bar 14, which has the axis is same as the piercing axis X and supports a plug at its tip, is disposed on the downstream side. A billet is traveled forward, is spirally rotated, is pierced, and becomes a hollow shell at the downstream side.

Figure 2:
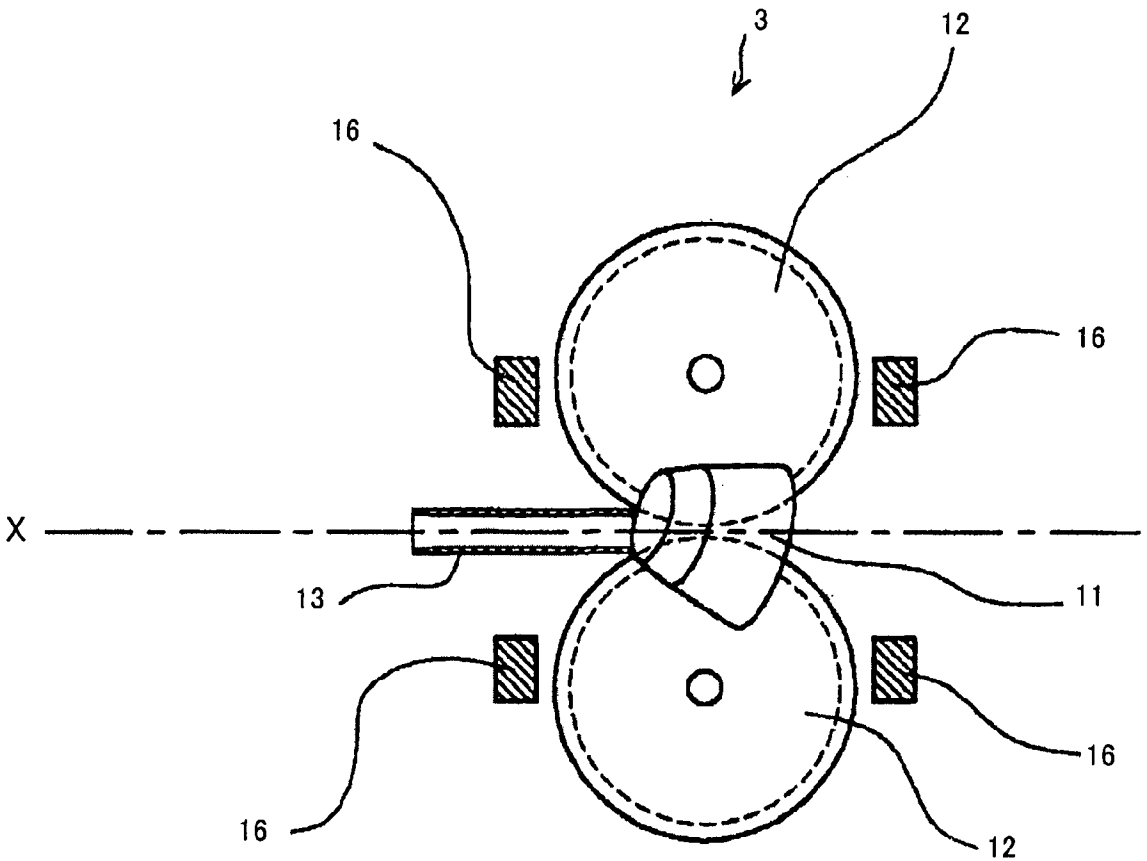
FIG. 2 is a schematic plan view showing a horizontal section of a center portion of the piercing mill.

FIG. 2 is a schematic plan view showing the case where the center portion of the piercing mill 3 is cut in the horizontal direction. In FIG. 2, the piercing mill 3 has a housing framed by four supports 16. A pair of the main rolls facing each other are provided in the vertical direction and put the piercing axis X between them (in FIG. 2, only the upper main roll 11 is shown). A pair of the disc rolls 12 are disposed horizontally on both sides of the piercing axis X, so that each guide face faces each other and each rotary axis extend in the vertical direction.

A billet starts from the cannon 13 on the upstream side (the left side in the diagram) of the piercing mill. On the downstream side, a plug bar (not shown in FIG. 2) for holding a plug is disposed on the piercing axis X. A billet is pierced by the piercing mill 3 and becomes a hollow shell. The hollow shell is carried out to the downstream side (the right side in the diagram).

Figure 3:
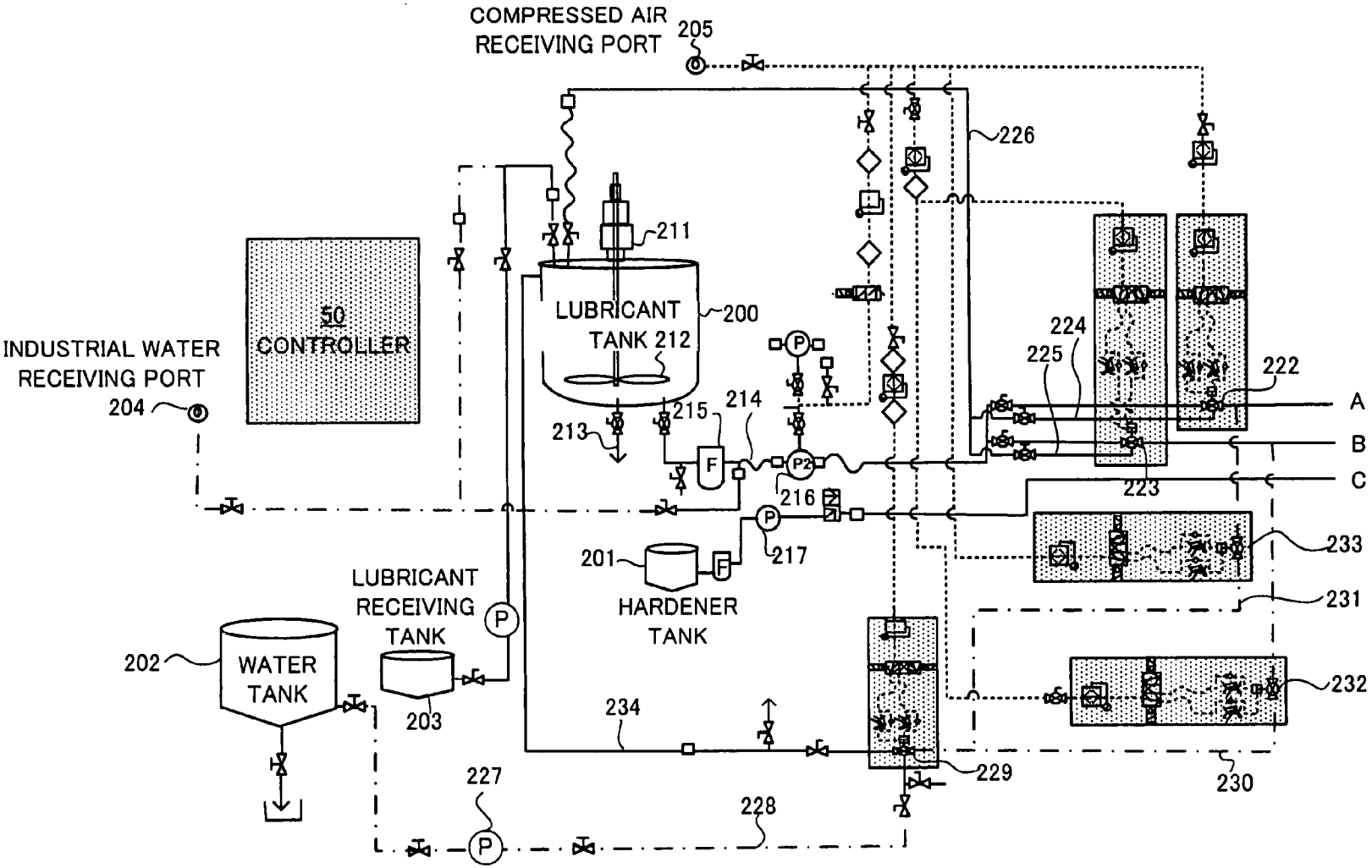
FIG. 3 is a conceptual diagram mainly showing storage/supply sides of a system for supplying a lubricant to disc rolls of the piercing mill.
Figure 4:
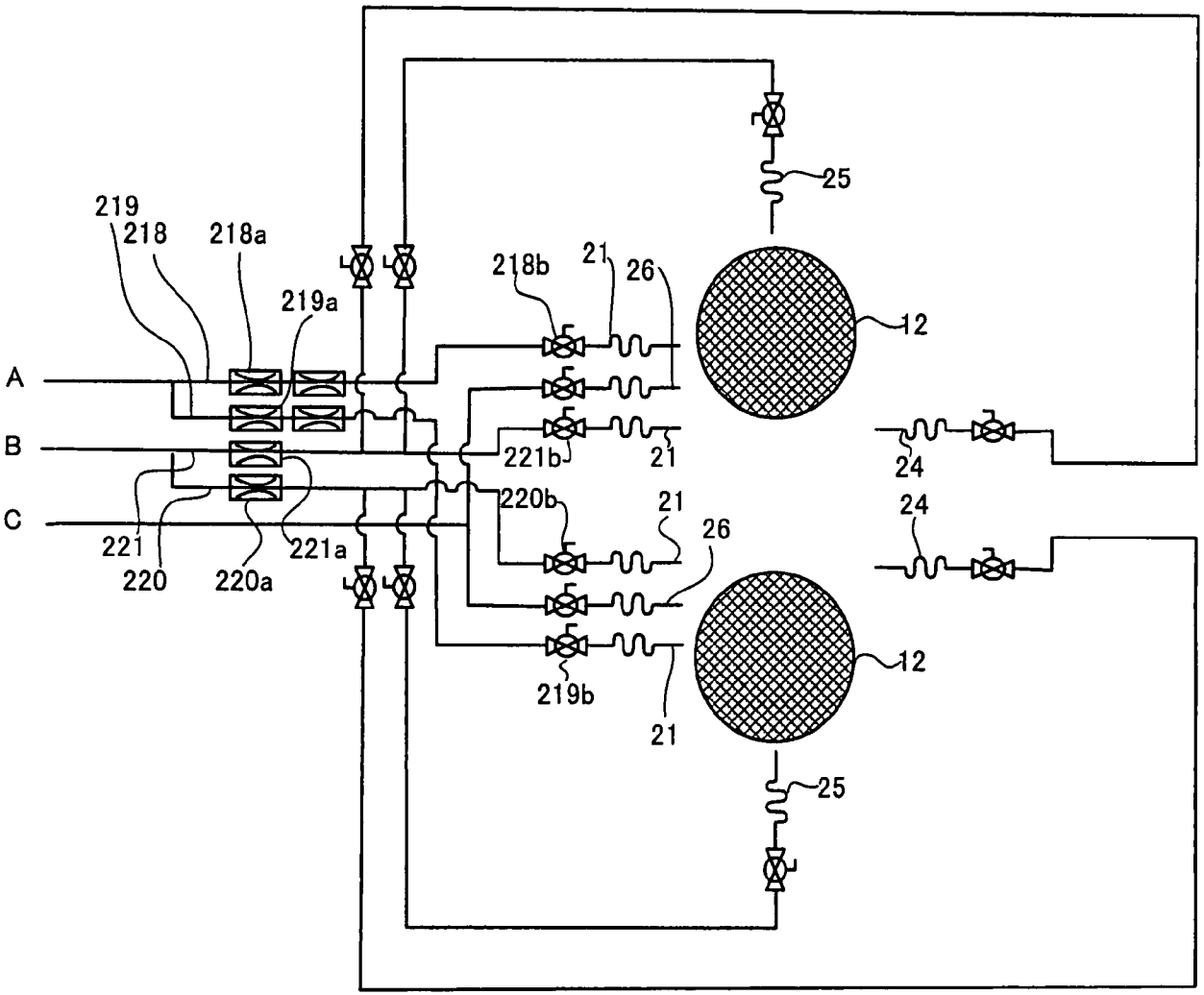
FIG. 4 is a conceptual diagram mainly showing the plumbing connected to the nozzles.

FIGS. 3 and 4 schematically show a system for supplying a lubricant. Symbols A, B, and C shown on the right side in FIG. 3 and on the left side in FIG. 4 indicate that the pipes marked by the symbols in the diagrams are extended. With reference to FIGS. 3 and 4, this system in the embodiment will be described.

The system for supplying a lubricant has a lubricant tank 200 for storing a main lubricant, a solidifier tank 201 for storing a solidifier for solidifying the main lubricant, a water tank 202 for storing water, a main lubricant receiving tank 203 for receiving the main lubricant, an industrial water receiving port 204 for receiving industrial water from the outside, and a compressed air receiving port 205 for receiving compressed air from the outside. In the diagrams, the solid line indicates a plumbing of the lubricant, an alternate long and short dash line indicates a plumbing of water, and a broken line indicates a plumbing of compressed air.

As shown in FIG. 3, the lubricant tank 200 has a motor 211 and an agitator 212 driven by the motor 211. With the configurations, the lubricant in the tank 200 is always agitated so that it prevents precipitation or solidification in the tank and the main lubricant is always supplied evenly. Although not shown, the lubricant tank 200 has a temperature sensor, a heater, a cooler, and the like. By these elements, the main lubricant is always kept at predetermined temperature and is supplied to the disc rolls. The lubricant tank 200 is provided with a drain 213 for removing all of the lubricant in the tank as necessary.

The main lubricant is led from the lower portion of the lubricant tank 200 through a plumbing 214 to a plumbing 216 via a filter 215 and is force fed via pipes shown by symbols A and B in the diagrams to lubrication portions by the pump 216.

FIG. 4 is a schematic plan view showing the disc rolls 12 and a system for supplying the lubricant near the disc rolls 12. To clearly show the lubrication portion in FIG. 4, the distance between the disc rolls 12 is shown so as to be exaggerated.

The main lubricant pumped by the pump 216 is sprayed via the pipes expressed by the reference symbols A and B at the left end of FIG. 4 toward the guide faces 12*a* of the disc rolls from four nozzles 21 disposed on the inlet side of the piercing mill, two nozzles 24 and 24 disposed on the outlet side of the disc rolls 12, and nozzles 25 and 25 disposed on the sides of the disc rolls 12.

When slip between main rolls and a material occurs, the main lubricant may be sprayed only from the nozzles 21 on the inlet side of the piercing mill.

On the other hand, in the case where the main lubricant has to be solidified, a solidifier is used. As shown in FIG. 3, the solidifier is led from the solidifier tank 201 to a pump 217 and is pumped by the pump 217 to a lubrication portion via a pipe C. In FIG. 4, the solidifier is sprayed from the nozzles 26 toward the disc roll guide faces 12*a*. By this time, the main lubricant has been already sprayed and applied to the guide faces 12*a*. The solidifier is sprayed onto the main lubricant layer formed on the guide faces 12*a*.

During the piercing process of seamless pipes or tubes, as described above, the main lubricant is sprayed from the nozzles 21 toward the disk roll guide faces 12*a* and, further, the solidifier is sprayed from the nozzles 26 toward the disc roll guide faces 12*a* as necessary. In this case, flowmeters 218*a*, 219*a*, 220*a*, and 221*a* are provided for plumbings 218, 219, 220, and 221 directly connected to the four spray nozzles 21 on the inlet side of the piercing mill. Valves 218*b*, 219*b*, 220*b*, and 221*b* are provided so that the flow rate can be adjusted in accordance with the results of measurement of the flowmeters.

After piercing process or in some case that the piercer is at work, the main lubricant from the nozzles 21 is stopped. In this case, the flow direction of the lubricant is changed. The lubricant flows from the nozzles 21, 24, or 25, to plumbings 224 or 225 by three way valves 222 or 223. The return plumbings 224 and 225 are combined to one return plumbing 226. The return plumbing 226 extends to the lubricant tank 200. Since the pump 216 always operates, when spraying toward the disk roll guide face 12*a* is not performed, the main lubricant circulates in the plumbings 214, 224, 225, and 226 from the lubricant tank 200. Therefore, even in the case where the main lubricant has the property of easy solidifying, the situation that the main lubricant remains in the plumbings and closes the plumbings is prevented.

Further, in the case of stopping the piercing mill 3 for relatively long time, to prevent the lubricant from remaining in some point between the pipes A, B and spray nozzles 21,24,25 and closes the plumbings, cleaning with water can be performed. Cleaning with water is performed by supplying industrial water pumped from the water tank 202 by a pump 227 to the pipes A and B via a plumbing 228, a three way valve 229, plumbings 230 and 231 branched after the three way valve 229, and three way valves 232 and 233. As necessary, the main lubricant and industrial water remaining in the plumbings can be ejected from the ejection port by using compressed air (which is supplied to the plumbings indicated by broken lines in the diagram).

In the case of stopping spray and making the main lubricant circulate in the plumbings, the lubricant remaining in some point from the pipes A and B to the nozzles is led to the three way valve 229 via the three way valves 232 and 233 and plumbings 230 and 231 and returned from the three way valve 229 to the lubricant tank 200 via a plumbing 234 in the reverse path by using the compressed air led to the system.

Figure 5:
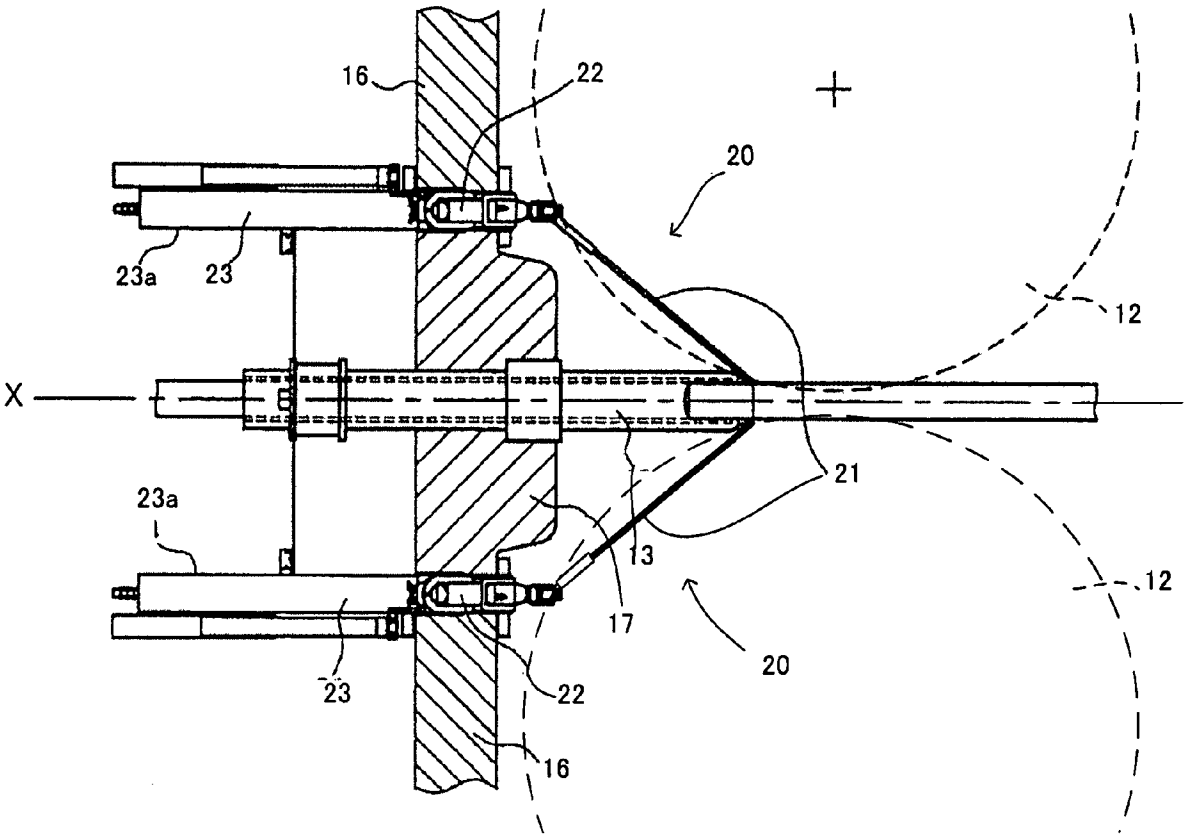
FIG. 5 is a plan view showing the position of the nozzles.

FIG. 5 is a plan view showing the spraying device 20 in the piercing mill 3. The spraying device 20 has the nozzles 21 capable of spraying the lubricant from its tip, a multiaxial arm 22 capable of changing the spraying direction of the nozzles 21 and a unit 23 for enabling the multiaxial arm 22 to be carried in the piercing mill. The spraying device 20 is provided so as to be able to travel forward and backward in the directions parallel to the piercing axis X (the horizontal directions in the diagram) through the opening of a housing 17 between the supports 16 on the upstream side of piercing. With the configuration, the lubricant is sprayed from the tip of the spray nozzles 21 toward the guide position which is in contact with the shell in the guide faces of the disc rolls 12 near the tip of the cannon 13. In the embodiment, the nozzles 21 are positioned below the disc rolls 12 so as to avoid contact between the spray nozzles 21 and the disc rolls 12. Although FIG. 5 shows the example in which the spraying device 20 is disposed only on the inlet side of the piercing mill 3, in addition, the spraying device 20 may be disposed so as to spray the lubricant from the outlet side of the piercing mill 3, the mill drive side, and/or the operator side direction toward the disc roll guide faces 12*a*, using four supports 16 of the piercing mill housing.

Figure 6:
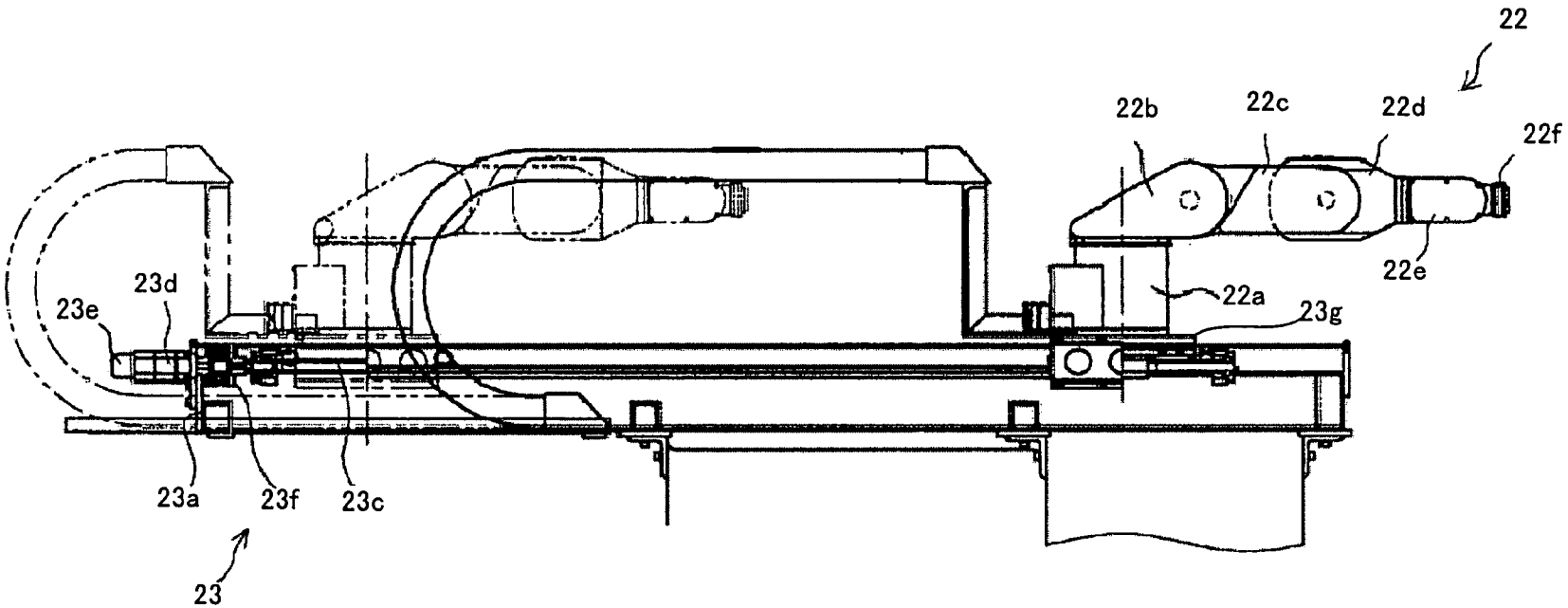
FIG. 6 is a front view showing a multiaxial arm positioned on the unit for moving the multiaxial arm.
Figure 7:
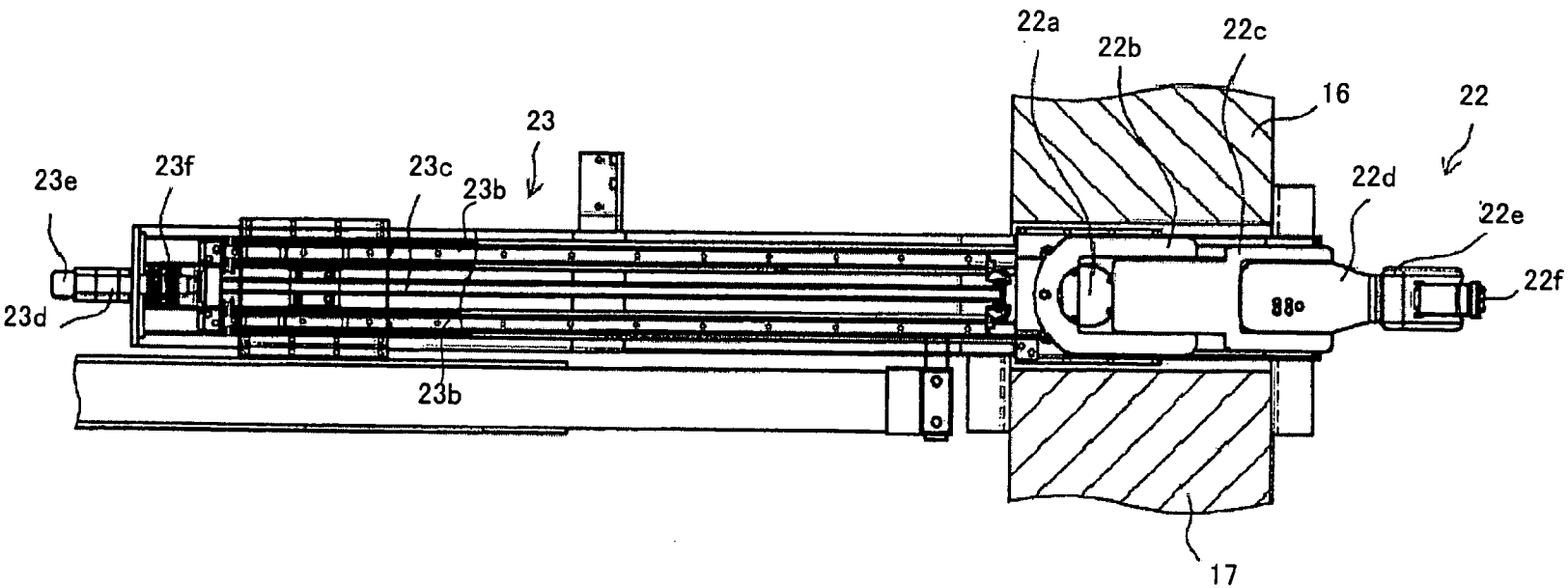
FIG. 7 is a plan view of FIG. 6.

FIG. 6 is a front view in which the multiaxial arm 22 is positioned on the piercing side of the unit 23. FIG. 7 is a plan view of FIG. 6.

The unit 23 has a guide board 23*a* horizontally fixed to a frame parallel to the piercing axis X on the inner face of the support 16 on the piercing upstream side, two rails 23*b* fixed on the guide board 23*a* and extend along the guide board 23*a*, a ball screw 23*c* positioned between the rails 23*b* and moving a seating 23*g* on which the multiaxial arm 22 is placed; a motor 23*d* for rotating the ball screw 23*c*, and a sensor 23*e* for measuring the rotational speed of the motor 23*d*.

The front end on the piercing side of the guide board 23*a* is positioned on the inner face of the support 16 and the rear end extends to the outside to an extent that the nozzles 21 are not positioned on the inside of the four supports 16 when the nozzles 21 are carried backward.

The motor 23*d* is fixed to the rear end of the guide board 23*a* and the front end side of the motor 23*d* and the rear end of the ball screw 23*c* are connected to each other via a coupling 23*f* through the opening of the guide board 23*a*. By the rotation of the motor 23*d*, the ball screw 23*c* rotates. The sensor 23*e* is connected to the rear end of the motor 23*d* to measure the rotational speed of the motor 23*d*.

The multiaxial arm 22 is mounted on the seating 23*g*. By the movement of the seating 23*g* on the guide board 23*a*, the multiaxial arm 22 moves along the guide board 23*a*.

In a lower part of the seating 23*g*, seating guide grooves in which the rail 23*b* is fit and a screw nut positioned between the seating guide grooves and screwed with the ball screw 23*c* are fixed.

The proximal part of the multiaxial arm 22 is attached to the seating 23*g* and the multiaxial arm 22 is configured by six arms from the first arm 22*a* to the sixth arm 22*f*.

The first arm 22*a* has a short cylindrical shape and the lower end of the first arm 22*a* is swingably attached to the seating 23*g*. The upper part of the first arm 22*a* has a two-stage cylindrical shape having a small diameter, and the upper-stage cylindrical part having a small diameter is fit in the circular bottom portion of the second arm 22*b* having an U shape in plan view. The second arm 22*b* is swingable in the plan direction around the first arm 22*a* as a center in plan view and can swing to the right and left with respect to the seating 23*g*, for example, through 315 degrees.

The proximal portion of the third arm 22*c* having a Y shape in plan view is fit in the tip portion of the second arm 22*b*. They are swingably attached to each other by a horizontal axis, and the tip of the third arm 22*c* can move vertically, for example, in the range of 225 degrees.

The rear portion of the fourth arm 22*d* whose front portion has a frustrum shape and whose rear portion has a prism shape is fit in the front end of the third arm 22*c*. The fourth arm 22*d* and the third arm 22*c* are swingably attached to each other by a horizontal axis. Like the motion of the third arm 22*c*, the front end of the fourth arm 22*d* is movable in the vertical direction with respect to the third arm 22*c*.

The fifth arm 22*e* has a width almost the same as that of the front end portion of the fourth arm 22*d* in plan view and is formed in a "U" shape in plan view. The plane portion of the front end face of the fourth arm 22*d* and the plane portion of the bottom of the fifth arm 22*e* are in contact with each other and are connected so as to be swingable with respect to the front end face of the fourth arm 22*d* in the axial direction of the fourth arm 22*d*.

Further, the rear portion of the sixth arm 22*f* is fit in the portion having the "U" shape of the front end portion of the fifth arm 22*e* and swings around the axis extending in the direction of the front end portion of the "U" shape as a center.

As described above, the multiaxial arm 22 is configured by the six arms from the first arm 22*a* to the sixth arm 22*f*, and the neighboring arms are swingably connected to each other by a single axis. With the structure, swing to the right and left in the horizontal plane direction and swing to the up and down in the vertical plane direction are enabled. For each of the swing axes, a servo motor is built in. By the servo motor, the arm is operated by a predetermined amount.

Figure 8A:
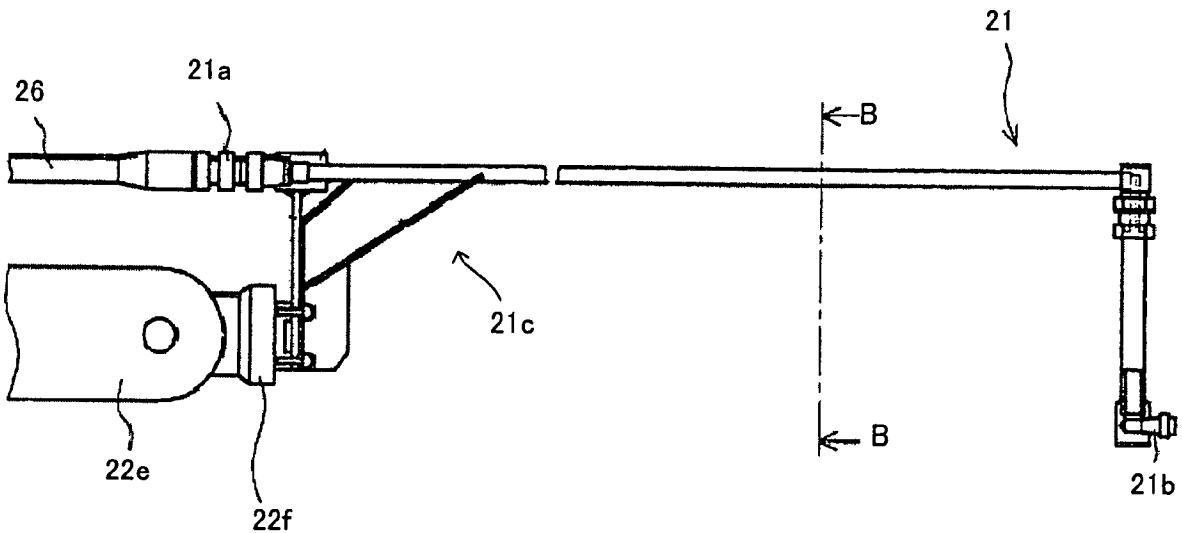
FIG. 8A is a front view of an nozzle and FIG. 8B is a cross section taken along line B-B of FIG. 8A.
Figure 8B:
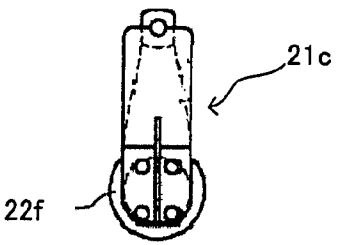

FIG. 8 is a diagram showing the nozzle 21 attached to the tip of the multiaxial arm 22. FIG. 8A is a front view and FIG. 8B is a cross section taken along line B-B of FIG. 8A. In the following description, the nozzle 21 will be described. The nozzles 24 and 25 may employ a configuration similar to that of the nozzle 21.

The nozzle 21 is a tube having a small diameter and a predetermined nozzle tip 21*b* is screwed in the front end. The proximal portion is fixedly supported by the sixth arm 22*f*, and a joint 21*a* for connection to the pipes A and B for supplying the lubricant is attached.

The proximal portion of the nozzle 21 and the sixth arm 22*f* are connected to each other via an intermediate member 21*c* for stably attaching the nozzle 21. The intermediate member 21*c* is fixed to the sixth arm 22*f* by four screws.

With the configuration, the orientation direction of the sixth arm 22*f* becomes the direction of the nozzle 21, and the lubricant can be sprayed by making the nozzle 21 directed to any of the up, down, right, and left sides.

For example, the operation of the spraying device 20 can be performed by switching between automatic operation and manual operation by a switch provided for a mill operation board in an operation chamber for operating the piercing mill 3. In the case of the automatic operation, in accordance with positional information of the disc rolls 12 and the like from a process computer, the position of the nozzle 21 corresponding to the positional information which is preset and prestored is computed and a controller 50 (refer to FIG. 3) executes a control so that the nozzle 21 is positioned in the computed position.

The entry and recession of the nozzle 21 does not mean simple forward travel and backward travel but the connection portions of the arms of the multiaxial arm 22 operate so that the nozzle 21 travels forward/backward while moving three-dimensionally and avoiding touch other members.

In the case of manual operation, an entry/recession amount of the nozzle 21 and a movement amount in the horizontal and vertical directions can be instructed by an operation on a button or the like. The lubricant can be sprayed or stopped. An operation board may be provided near each of the two disc rolls 12 so that the operator can operate the operation board while seeing the nozzle 21.

As described above, there are cases that the inclination angle or the crossed axes angle of the main rolls 11 in the piercing mill 3 is variously changed. Accordingly, the position or the kind of the disc rolls is variously changed in the direction of reducing friction between the guide faces 12*a* of the disc rolls 12 and the shell in accordance with spiral travel of the shell. Therefore, the position and orientation of the guide faces variously change.

Figure 9:
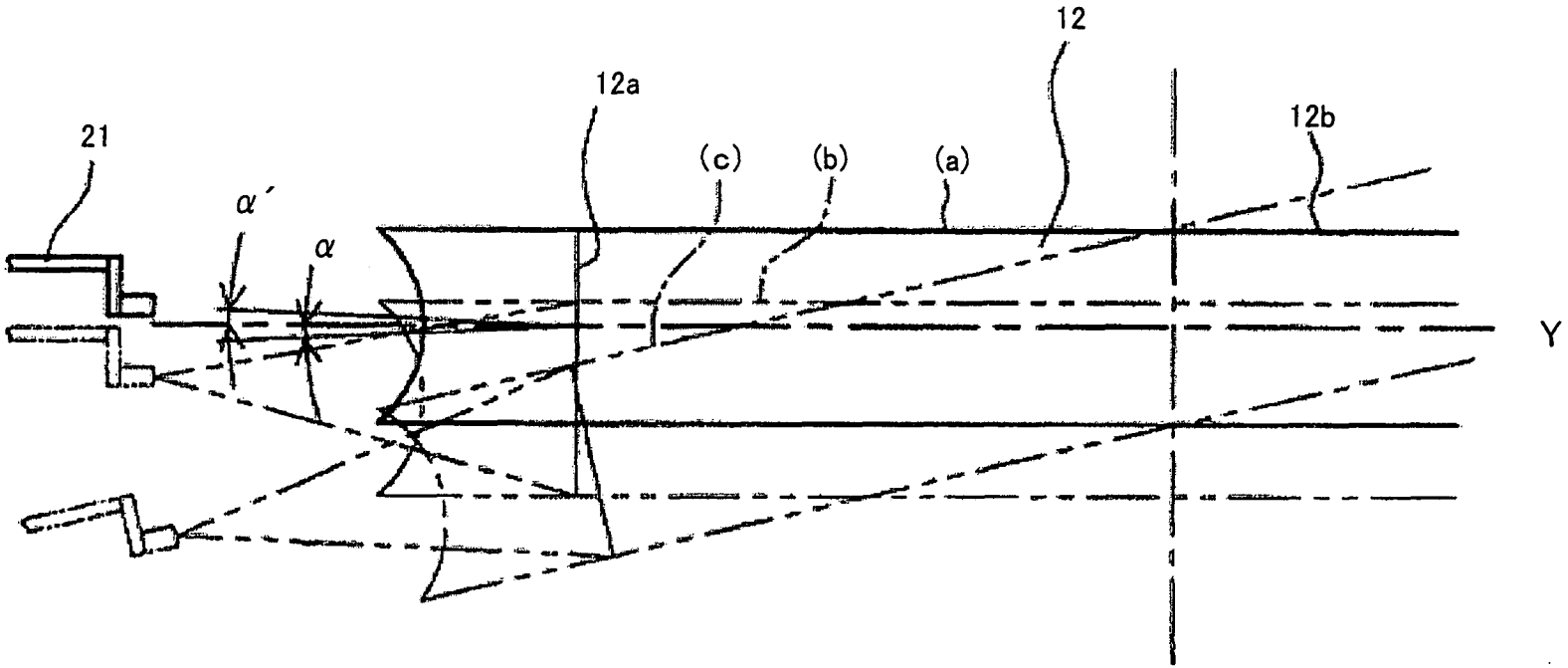
FIG. 9 is a front view exaggeratingly showing the posture of the disc rolls.
Figure 10:
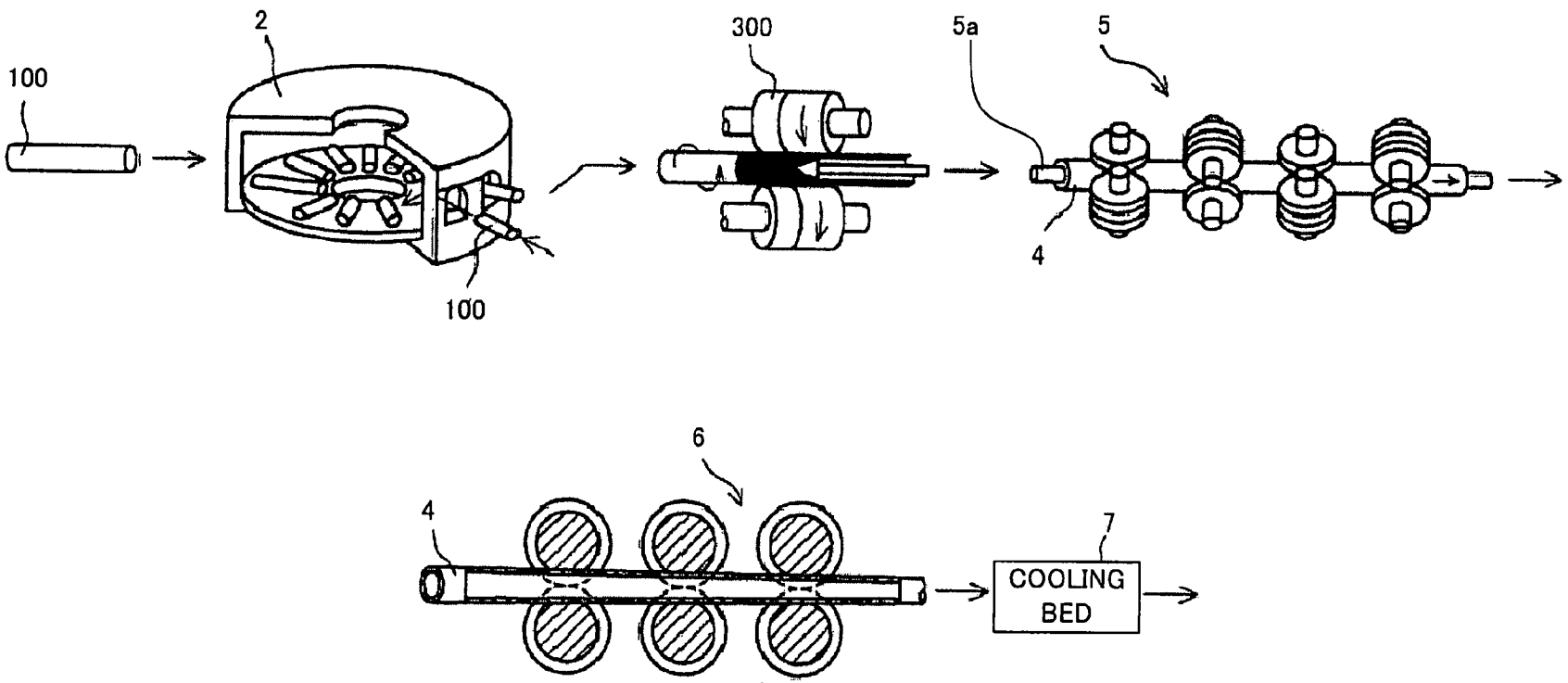
FIG. 10 is a diagram showing an example of a process of manufacturing seamless pipes or tubes by a method using a mandrel mill.
Figure 11:
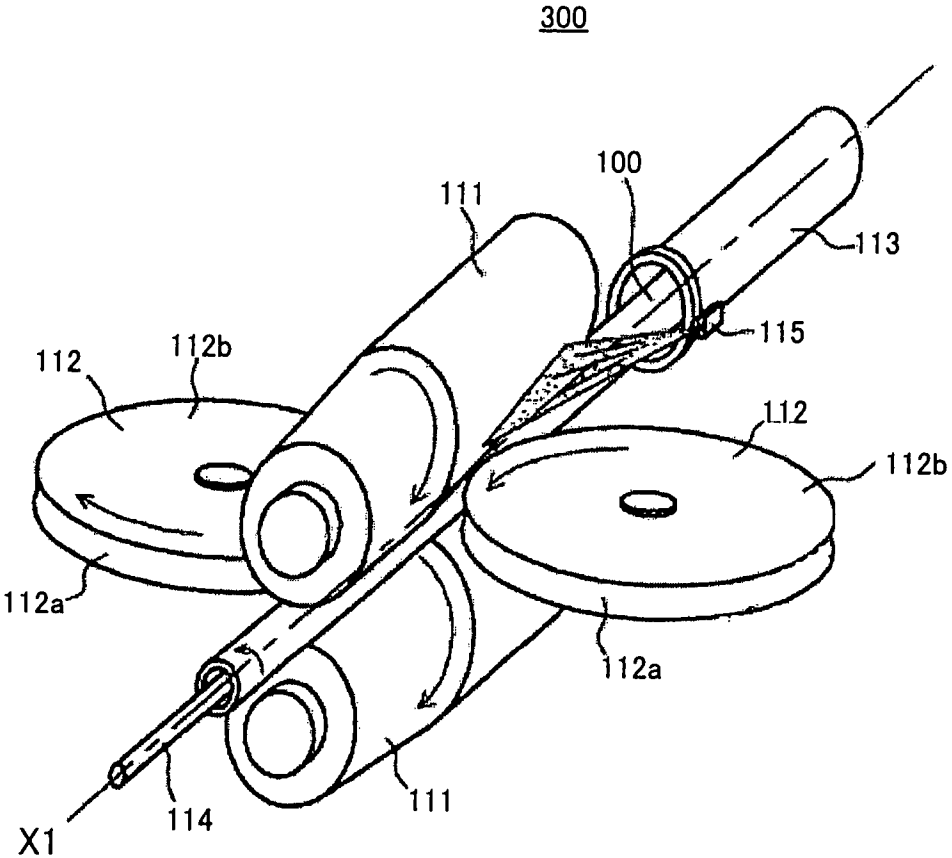
FIG. 11 is a diagram showing an example of the piercing mill.

FIG. 9 is a front view exaggeratedly showing the position of the disc roll 12 for easier understanding. The left side of the drawing sheet of FIG. 9 is a piercing upstream side and a billet is moved from the left to the right of the drawing sheet and pierced. A billet (not shown) exists on this side of the drawing sheet of the disc roll 12 and travels spirally forward while rotating right.

(a) in FIG. 9 shows a state where the disc roll 12 is set horizontally. (b) shows a state where the disc roll 12 is in the horizontal state but is lower than the standard position of (a) due to, for example, reduction in the size of the hollow shell. (c) shows a state where, although the center position of the disc roll 12 is the same as that in (a), since a piercing method of increasing the right rotation more than the forward travel amount due to the harder material of the billet is set, the disc roll 12 is also tilted.

As described above, the position and posture of the disc roll 12 is adjusted according to the size of the shell and the material of the billet. Also in the case where the position and inclination of the guide face 12*a* changes in association with the adjustment, since the piercing mill 3 according to the embodiment can move forward/backward in the piercing direction and has the multiaxial arm 22, the nozzle 21 can be oriented toward the guide face 12*a* and the lubricant can be uniformly sprayed and applied onto the guide face 12*a*.

12*b* in the disc roll 12 in the standard position (a) in FIG. 9 indicates the plane of the disc roll 12, and a center plane which is parallel to the plane 12*b* and passes the center in the width direction of the guide face 12*a* is expressed by Y. The angle ($\alpha$, $\alpha'$) from the center plane Y, of the spraying direction of the nozzle 21 is preferably within five degrees. For example, in the case of FIG. 9, the inclination of the nozzle 21 is adjusted to the inclination of the disc roll 12, so that the angle from the center plane Y is always 0 degree.

EXAMPLES

Example 1

The influence of the spraying angle of the lubricant toward the guide face on roughness of the guide face after rolling in an apparatus for manufacturing seamless pipes or tubes according to the present invention was examined. 50 billets were pierced and the guide face after piercing was evaluated. The experiment conditions are as follows.

Disc roll diameter: 3300 to 3350 mm
Disc roll width: 225, 310, 360 mm
Arc radius of curved guide face: 225, 310, 360 mm
Disc roll rotational speed: 16 to 25 rpm
Component of lubricant to be applied: mixture of iron oxide ($Fe_2O_3$) and water glass
Spraying volume of lubricant: 4 liter/min. per disc roll
Spraying direction of nozzle: −7° to +7° from the center plane passing the center in the width direction
Distance between nozzle end and guide face: 150, 250 mm Spraying pressure of lubricant: 0.2 MPa Splaying angle of lubricant: apex angle of spray cone 15 degrees conically Table 1 shows the result. In Table 1, "+" in the column of the spraying angle with respect to the center plane indicates upward spraying angle with respect to the center plane, and "−" indicates downward spraying angle with respect to the center plane. "○" in the evaluation column denotes that the ratio of the roughness area in the guide face after piercing 50 billets is less than 10% as a whole, "Δ" indicates that the ratio of the roughness area is less than 30%, and "x" indicates that the ratio of the roughness area is 30% or higher.

It is understood from Table 1 that when the spraying angle with respect to the center plane lies within ±5 degrees, the lubricant can be uniformly applied to the guide face and roughness on the guide face can be reduced.

TABLE 1

| Angle (degrees) of spray with respect to center plane | Evaluation | |
|---|---|---|
| | 150 (mm) | 250 (mm) |
| +7 | Δ | x |
| +6 | Δ | x |
| +5 | ○ | ○ |
| +4 | ○ | ○ |
| +3 | ○ | ○ |
| −3 | ○ | ○ |
| −4 | ○ | ○ |
| −5 | ○ | Δ |
| −6 | Δ | x |
| −7 | Δ | x |

The distance in the evaluation column indicates the distance between the nozzle end and the guide face.

Example 2

A piercing mill in a process of manufacturing a seamless pipes or tubes with a mandrel mill pierced billets as follows.

In Example 2, the lubricant was sprayed under the following conditions by using the spraying device from the upstream side of the piercing mill toward the guide face of the disc roll. On the other hand, in a comparative example, the lubricant was not sprayed toward the guide face under the same piercing conditions but the equal volume of the same lubricant was sprayed from the nozzles attached to the cannon to the main rolls.

1) Piecing Rolling Conditions

Outside diameter of billet: 225 mm

Material of billet: stainless steel

Outside diameter of hollow shell: 225 mm

Disc roll diameter: 3350 mm

Disc roll width: 200 mm

Arc radius of curved guide face: 225 mm

Disc roll rotational speed: 15 rpm

2) Conditions of Spraying Lubricant

Component of lubricant: mixture of iron oxide ($Fe_2O_3$) and water glass

Volume of lubricant: 4 liter/min. per disc roll

Spraying direction of nozzle: $\alpha=0°$

Average distance between nozzle and guide face: 150 mm

Spraying pressure of lubricant: 0.2 MPa

Spraying angle of lubricant: cone angle 15 degrees conically

3) Experiment Result

By using the spraying device of the present invention, as compared with a device of the comparative example, the number of piercing until frequency of seizure was increased from 50 to 200. The trouble ratio of piercing such as clogging of the tip of a billet, clogging in a rear end, and the like was decreased from 5% to 1% or less. Further, as compared with the device of the comparative example, the number of nozzles could be reduced from 12 to 2. It cuts the time for replacing nozzles accompanying a change in piercing condition by 45 minutes per work.

The invention is not limited to the foregoing embodiment but the number of axes of the multiaxial arm, the length of each of the arms, the swing angle of the arm, and the like can be also changed.

The invention claimed is:

1. A system for supplying a lubricant to a pair of disc rolls of a piercing mill, comprising:

a storage tank of the lubricant;

a plumbing extended from the storage tank to a position near the disk rolls;

a spray nozzle provided at the tip of the plumbing;

a device for switching flow direction provided in some midpoint of the plumbing;

a plumbing extending from the device for switching flow direction to the storage tank; and a device for releasing pressure in the plumbing to the storage tank while the piercing mill is not at work, the pressure releasing device provided between the switching device and the spray nozzle.

2. The system for supplying the lubricant according to claim 1, further comprising a flow controller for controlling flow rate of the lubricant in each plumbing directly connected to the spray nozzle.

3. The system for supplying the lubricant according to claim 1, wherein the spray nozzle is configured so as to be flexibly directed toward the guide faces of the disc rolls in accordance with change in a size or a position of the disc rolls.

4. The system for supplying the lubricant according to claim 1, further comprising a cleaning device for the plumbing.

5. The system for supplying the lubricant according to claim 1, further comprising a device for supplying a solidifier for solidifying the lubricant.

6. An apparatus for manufacturing a seamless pipes or tubes, comprising:

a piercing mill including a plug oriented in a piercing direction, a pair of disc rolls disposed on both sides of an axis of the plug in a first plane including the axis, and a pair of main rolls disposed on both sides of the axis with a predetermined inclination to a second plane including the axis and orthogonal to the first plane; and a system for supplying a lubricant including a storage tank of the lubricant to be supplied to the disc rolls, a plumbing extending from the storage tank to a position near the disk rolls, a spray nozzle provided at the tip of the plumbing, a device for switching flow direction provided in some midpoint of the plumbing, a plumbing extending from the device for switching flow direction to the storage tank, and a device for releasing pressure in the plumbing to the storage tank while the piercing mill is not at work, the pressure releasing device provided between the device for switching flow direction and a spray port to the disc rolls of the plumbing.

7. The apparatus for manufacturing seamless pipes or tubes according to claim 6, further comprising:

a multiaxial arm to which the spray nozzle is attached and which can change a spraying direction of the spray nozzle; and a unit for moving the multiaxial arm forward/backward to/from the rolling mill.

8. A method of manufacturing seamless pipes or tubes by using a piercing mill having a pair of disc rolls while supplying a lubricant to the disc rolls, comprising:

supplying the lubricant to the disc rolls during piercing;

circulating the lubricant in a plumbing when piercing is not performed; and releasing pressure of the lubricant in the plumbing near a spraying port to the disc rolls to prevent dropping the lubricant from the spraying port when piercing is not performed.

9. The method of manufacturing seamless pipes or tubes according to claim 8, wherein the lubricant is sprayed toward a guide face at angles within five degrees from a center plane which is parallel to the side of the disc rolls and passes the center in the width direction of the guide face.

10. The method of manufacturing seamless pipes or tubes according to claim 8, wherein the lubricant is sprayed from the inlet side of a piercing mill.

11. Seamless pipes or tubes manufactured by a manufacturing method according to claim 8.

12. The system for supplying the lubricant according to claim 2, wherein the spray nozzle is configured so as to be flexibly directed toward the guide faces of the disc rolls in accordance with change in a size or a position of the disc rolls.

13. Seamless pipes or tubes manufactured by a manufacturing method according to claim 9.

14. Seamless pipes or tubes manufactured by a manufacturing method according to claim 10.

* * * * *

UNITED STATES PATENT AND TRADEMARK OFFICE

CERTIFICATE OF CORRECTION

PATENT NO. : 8,464,565 B2
APPLICATION NO. : 10/584271
DATED : June 18, 2013
INVENTOR(S) : Yusuke Hiraishi It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1630 days.

Signed and Sealed this
Eighth Day of September, 2015

Michelle K. Lee

Michelle K. Lee
*Director of the United States Patent and Trademark Office*